US012571106B2

(12) United States Patent
Thuss

(10) Patent No.: US 12,571,106 B2
(45) Date of Patent: Mar. 10, 2026

(54) BRITTLE PARTICLE COLD SPRAY (BPCS) TECHNOLOGY FOR THE DEPOSITION OF NANOSTRUCTURED AND MICROSTRUCTURED MULTICOMPOUND COMPOSITE MATERIALS

(71) Applicant: Richard C. Thuss, Berryville, VA (US)

(72) Inventor: Richard C. Thuss, Berryville, VA (US)

( * ) Notice: Subject to any disclaimer, the term of this patent is extended or adjusted under 35 U.S.C. 154(b) by 329 days.

(21) Appl. No.: 18/138,226

(22) Filed: Apr. 24, 2023

(65) Prior Publication Data

US 2023/0366098 A1 Nov. 16, 2023

Related U.S. Application Data

(60) Provisional application No. 63/403,733, filed on Sep. 3, 2022, provisional application No. 63/342,462, filed on May 16, 2022.

(51) Int. Cl.
*C23C 24/04* (2006.01)

(52) U.S. Cl.
CPC ..... *C23C 24/04* (2013.01); *Y10T 428/24967* (2015.01); *Y10T 428/26* (2015.01)

(58) Field of Classification Search
CPC ..... C23C 24/04; Y10T 428/24967; Y10T 428/26; C04B 2235/52; C04B 35/62222
See application file for complete search history.

(56) References Cited

U.S. PATENT DOCUMENTS

2020/0157689 A1* 5/2020 Mccall ..... H01F 10/26
2021/0135083 A1* 5/2021 Thuss ..... H10N 10/10

OTHER PUBLICATIONS

[NPL-1] "Lunar regolith", Wikipedia The Free Encyclopedia (accessed May 15, 2025); <https://en.wikipedia.org/wiki/Lunar_regolith>. (Year: 2025).*
[NPL-2] "Martian regolith", Wikipedia The Free Encyclopedia (accessed May 15, 2025); https://en.wikipedia.org/wiki/Martian_regolith>. (Year: 2025).*
[NPL-3] "Grain size", Wikipedia The Free Encyclopedia (accessed May 15, 2025); <https://en.wikipedia.org/wiki/Grain_size#Krumbein_phi_scale>. (Year: 2025).*

* cited by examiner

*Primary Examiner* — Donald M Flores, Jr.
(74) *Attorney, Agent, or Firm* — Lytle Patent Services, LLC; Catherine F. Lytle

(57) ABSTRACT

Brittle Particle Cold Spray (BPCS) deposition technology is controlled primarily by particle size distribution and particle shapes. Therefore, composite materials with unique material compositions and functional properties can be supersonic cold spray deposited by combining powders of the same or different functional brittle material types that have the same particle size distribution or by combining powders with complimentary particle size distributions that when mixed together produce the required particle size distribution for successful brittle particle cold spray deposition of the mixed compound. High temperature capability ceramic and carbon micro and nano fibers can also be incorporated into the cold spray material powder mix that when cold spray deposited produce random fiber Ceramic Matrix Composite (CMC) materials for high temperature thermal protection systems and other applications. Nanostructured composite and multicompound materials can also be supersonic cold spray deposited.

19 Claims, 14 Drawing Sheets

BRITTLE PARTICLE COLD SPRAY (BPCS) TECHNOLOGY FOR THE DEPOSITION OF NANOSTRUCTURED AND MICROSTRUCTURED MULTICOMPOUND COMPOSITE MATERIALS

The present application claims the benefit of the earlier filing dates of priority to U.S. provisional Application No. 63/342,462, filed on 16 May 2022 and U.S. provisional Application No. 63/403,733, filed on 3 Sep. 2022, the entire contents of both which being incorporated by reference herein in their entirety. The present application also contains subject matter related to that in U.S. Pat. Nos. 9,306,146, 10,714,671, 10,957,840, 11,473,200, 11,617,291 filed 30 Dec. 2020, the entire contents of which are being incorporated herein by reference in their entirety.

BACKGROUND

Conventional supersonic cold spray technology includes the deposition of a wide variety of metals from aluminium to titanium, and mixed metal/ceramic powders, and more recently a variety of polymeric materials. Metal and polymeric material cold spray technology is based on the use of malleable particles which individually splat and deform, then build up and knit together when they impact a surface at supersonic velocity. While ceramic and other brittle material particles have been added into the powder mix to produce high quality surface protection coatings, the fundamental process remains anchored to the deformability, or malleable nature of the metal or polymer components in the powder mix that act as a binder for the brittle material. Malleable binder material contents of 20-50 wt. % have been required to anchor the brittle material particles together.

Particles used in conventional cold spray applications are normally spherical in shape with a diameter of 5-70 microns depending on the cold spray equipment type, the material being sprayed, and the end use. Non-ductile or brittle material particles made from functional materials such as semiconductors, glassy and crystalline optical materials, hard and soft magnetic materials and hard ceramic structural coating materials such as silicon carbide, alumina, and zirconia that are greater than several tens of microns in size, however, do not adhere to each other or deposit into thick layers when they hit a surface at near supersonic or supersonic velocity, but instead they shatter or bounce off after sandblasting or eroding the surface.

Recent innovations by the inventor have shown that rapid cold spray deposition of 100% non-ductile, crystalline, or brittle material particles can be deposited onto both ductile and brittle substrates in both micron thick and centimetre thick material layers using a modified cold spray process which depends not on particle deformation at impact but primarily on the dense mechanical interlocking of different size brittle particles. By tailoring the powder particle size distribution and the cold spray equipment operational parameters, multiple categories and functional classes of brittle materials have been successfully deposited on both ductile and brittle substrates in thin to thick layers ranging from 20 μm to 2 cm in thickness or greater. This branch of cold spray deposition technology is now referred to as BPCS or Brittle Particle Cold Spray.

A fundamental difference between both metal cold spray and thin layer brittle material technology when compared to Brittle Particle Cold Spray (BPCS) technology comes from the shapes and the range of sizes of the particles required for material deposition. Thick or bulk layer cold spray deposition of non-malleable or brittle materials is not controlled by particle deformation or a partial melting process, but instead the material deposition begins and builds up as a result of mechanical interlocking of different size particles initially with small surface irregularities in the substrate which is then followed by particles of widely different sizes and irregular shapes impacting the material on the surface and mechanically interlocking with each other. For this interlocking and densification process to occur requires a wide distribution of particle sizes and the average particle size used in BPCS powders must be much smaller and the particles irregular in shape than those commonly used for traditional metal cold spray, polymer material cold spray and micron thick ceramic coating cold spray methods. Determination of the size and size distribution of very small particles as referenced in this application was done using a laser diffraction measurement system. Laser diffraction measures particle size distributions by measuring the angular variation in intensity of light scattered as a laser beam passes through a dispersed particulate sample. Large particles scatter light at small angles relative to the laser beam and small particles scatter light at large angles. The angular scattering intensity data is then analyzed to calculate the size of the particles responsible for creating the scattering pattern, using the Mie theory of light scattering The particle size is reported as a volume equivalent sphere diameter. All references to the size of irregular shaped particles in this application are equivalent spherical diameters when measured using this measurement technique.

Brittle Particle Cold spray (BPCS) deposition testing spanning a wide range of brittle material compositions and material functional types has shown that supersonic cold spray deposition of brittle material particles in greater than 20 to 100 microns in thickness requires both nano-meter and micrometer size particles in the powder mix and specific particle size distributions within the range from 100 nm to 15 μm in equivalent spherical size when measured using a laser diffraction technique.

Even small percentages of brittle material particles which exceed 20-30 micrometres in equivalent spherical size have been shown to disrupt the thick layer deposition process by cratering and eroding already deposited material.

The brittle particle cold spray (BPCS) process has been used to deposit a wide range of semiconductor materials including Bismuth and Antimony Tellurides, silver antimony telluride, germanium telluride (TAGS) materials, tetrahedrite formulations and other semiconductor copper sulfosalts. Ferroelectric materials including Barium Titanate in addition to magnetic materials including neodymium iron boride and praseodymium iron boride have also been successfully deposited using BPCS technology.

The mechanical interlocking and densification process that occurs during the supersonic cold spray of brittle material particles that have a specific particle size distribution from approximately 100 nanometers to 15 μm and irregular particle shapes enables a significant expansion of the applications for cold spraying brittle materials. Experiments have shown that the particle size distribution for brittle particle cold spray powders can be expanded to include particles down to 5 nm in size. In addition, the BPCS mechanical interlocking deposition process is not primarily controlled by the material type but instead deposition is enabled by the distribution of the particle sizes of the materials. This significantly expands the applications of BPCS beyond spraying a brittle material powder material composed of a single chemical compound and expands the applications of brittle particle cold spray to include materials whose properties can be enhanced or changed by the addition of very small nanoparticles of the same or different materials.

BPCS technology has been used for the sequential deposition of interlocking layers of different brittle materials with different chemical structures and functional properties because it is the particle size distribution in the individual material powders which primarily controls the deposition process. This mechanical interlocking process, therefore, also enables the deposition of graded composition materials where a gradual compositional transition from one brittle material type to another is made that is beneficial to the functional performance of the entire deposited material. As an example, the transition from one type of thermoelectric semiconductor material to another can be made. Specific nanoparticle dopants in the size range from 5-100 nm can also be added in order to optimize the net figure of merit for the cold spray deposited thermoelectric semiconductor elements and to cover a wider temperature operational range for electrical energy generation.

In addition, layered materials that gradually transition between 100% brittle material particles to 100% metal or other malleable materials can be fabricated using the cold spray process by mixing micron sized metal or other ductile material particles in different weight percentages into the brittle material powders. This gradual transition in the makeup of the powder from 100% brittle particles to 100% malleable or deformable particles can occur because the deposition process gradually changes from a process that is dominated by the mechanical interlocking of brittle particles to the standard metal cold spray process which is determined by the deformation of the malleable particles. This compositional layering from brittle to ductile materials can, as an example, be utilized to reduce thermal stresses at material interfaces caused by thermal expansion differences between the cold sprayed brittle material and a metal or polymer substrate material. The ability to transition from a 100% brittle semiconductor to a 100% metal conducting layer and/or transition from 100% metal conducting layer to a 100% brittle material layer also enables the complete cold spray additive manufacturing of functional mechanical or electrical devices that require both brittle functional materials and metallic or other ductile material elements.

Since the primary factors which determine the successful cold spray deposition of thick layers of brittle materials are the particle sizes, the particle size distribution, and the particle shapes, and to a lesser degree the type of functional material and the substrate compositions, it has been demonstrated by the inventor that the powder material used in the cold spray process can be composed of more than one chemical compound, and that those compounds can be from the same or different functional material groups. The cold spray deposited material can therefore be a mixture of two or more material compounds with different chemical compositions, and, therefore, different mechanical, electrical, chemical, and optical properties. Each component material can have different particle size ranges and particle size distributions that when mixed together create the particle size distribution required for the deposition of thick layers of brittle materials. By expansion of the particle size range that can be cold sprayed down to five nanonmeters, then specific material thermal, electrical, structural, and optical properties can be controlled or modified. As an example, brittle particle semiconductor and magnetic materials have been cold sprayed with the addition of up to 20 volume percent of five nanometer synthetic diamond particles and up to 20 volume percent of carbon nanoparticles in the 30 nm size range.

This ability to combine and mix materials with different particle sizes and particle size distributions allows for the cold spray deposition of ceramic matrix composite materials for use in high temperature thermal protection system applications which incorporate high temperature glass, ceramic, or carbon fibers and carbon nanotubes in the powder mix. Micro-fiber reinforced composite brittle materials have been cold sprayed with amorphous silica fiber with a diameter of approximately 1.5 μm and fiber aspect ratios of 100 in volume percentages up to 20%. Composite materials have been cold sprayed using carbon nano tube contents of 20 volume percent or higher.

While the primary applications of these innovative methods and products apply to cold spraying micro and nano-structured brittle materials, the process of the mechanical interlocking of particles spanning the range from 5 nm to 15 microns during the cold spray process also applies to metals, and polymer materials, Ductile material powders can be composed of different ductile materials, and reinforcing micron sized ceramic fibers can be added to the ductile material powder mix.

A specific application for both ceramic and metal materials is the addition of up to 20% of Johns Manville amorphous silica Q-Fiber to the cold sprayed powder. A unique aspect of this fiber resulting from its initial manufacturing process is that it exhibits shrinkage when exposed to high temperatures. Incorporating this fiber into a ceramic or metal matrix cold sprayed powder results in the material being held in compression by the fiber shrinkage which occurs during the cold spray process or during post cold spray deposition thermal processing. This produces a pre-stressed composite material.

SUMMARY OF THE DISCLOSURE

By the use of the mechanical interlocking and densification process that occurs when using a range of particle sizes and specific particle size distributions required for the cold spray deposition of non-malleable, brittle functional material particles, multi compound, nano-structured and micro-structured brittle material compounds can be deposited using Brittle Particle Cold Spray (BPCS) deposition technology. Layers of brittle materials composed of two to ten or greater chemical compounds ranging in thickness from 20 micrometres to several centimetres can be deposited using a cold spray deposition method where the deposited material in any one layer is composed of multiple chemical compounds consisting of the same or different functional material types.

Layers of mixed material compounds can be cold spray deposited where each individual chemical compound in the mix is composed of particles which span the entire 5 nanometer to 15 micrometer size range, or the cold spray powder can be produced with the particles of each material constrained to a specific particle size range or discrete particle size ranges. For example, but not limited to, compound one is composed of particles of a first brittle material compound with a D(10) to D(90) volumetric size range from 5 nm to 100 nm, a second composition material with particles for an example limited to a D(10) to D(90) volumetric size range from 100 nm to 500 nm, a third brittle material compound with particles in a D(10) to D(90) volumetric size range from 500 nm to 1.5 μm and one or more additional materials which cover a volumetric particle size range from D(10) to D(90) of 1.50-15 μm.

[The resulting cold spray deposited mix of material types and chemical compositions produces a nano-structured and micro-structured material with nanometer and micrometer sized compound particles. The compounds which have been included within the powder mix having different chemical compositions and atomic structures, and which exhibit a wide range of chemical composition, chemical reactivity, and structural, thermal, electrical, optical and magnetic properties. The mixed-compound powder used in the supersonic cold spray process is controlled to volumetrically have greater than 95% of the particles with a maximum particle size not greater than 15 micrometers, and a controlled volumetric particle size distribution over the nominal particle size ranges from 5-100 nm, 0.10-1.0 micrometers; 1.0-2.0 micrometers; 2.0-5.0 micrometers; and 5-10 micrometers in major dimension, and the powder can be composed of but not limited to from 2-10 different composition materials.

Materials with a very narrow particle size range, such as 5-10 nm can be added to the powder mix to modify a specific chemical, thermal, electrical or structural or other property of the cold sprayed material. Multi compound material powders composed of 100% brittle materials can be cold sprayed, and the presence of metallic, organic or any ductile material binder materials is not required within the mix of compounds. Metals and other malleable material powders such as polymers, however, may be added to the powder mix to achieve specific electrical, magnetic, chemical, optical or structural characteristics of the deposited material. High temperature ceramic and carbon micro and or nano fibers with aspect ratios of 100 or greater can be incorporated into the cold spray powder to produce high temperature ceramic composite materials.

Material types which can be incorporated into the powder mix include, but are not limited to, n-type and p-type semiconductors, hard and soft magnetic materials, ferroelectric materials, optical materials, metallic materials, superconductors, ionic semiconductors, high temperature ceramic materials such as fused quartz, mullite, zirconia, silicon carbide, boron carbide, and polymeric materials. Using this process, the mixed-compound powder material, which has been partitioned into specific particle size domains for each different compound can be deposited onto flat as well as complex shaped surfaces in both thin and thick layers, and from individual small pellet sized spots to large continuous areas, thus enabling coatings and bulk material depositions which exhibit functional properties that are specifically tailored to the application.

Supersonic cold-spray deposition of mixed compound brittle material powders, including a wide range of thermoelectric semiconductors, piezoelectric materials hard and soft magnetic materials, synthetic diamond, fused quartz, borosilicate glass, silicon carbide, carbon·boron carbide, boron nitride, and metallic elements such as alumium and nickel have been demonstrated, and these processes can apply to all classes of functional materials. Unique powder material compositions, particle shape and sizes, and control of the cold-spray process parameters and equipment design allow the uniform cold spray deposition to a surface of nano structured and microstructured materials where both different compound compositions and particle size ranges are used to control the deposited material's electrical, magnetic, optical, and structural properties and chemical reactivity.

In addition, brittle material powders constructed from one or more brittle materials can be further modified by the addition of high temperature micro and/or nano-fibers and/or hollow microspheres and nanospheres and then cold spray deposited to produce fiber reinforced high temperature composite materials, and high temperature syntactic foams. This ability to add high temperature nano and microfibers into the ceramic or brittle particle powder mix allows the gradual transition within the deposited cold spray material from a random high temperature ceramic fiber reinforced brittle material to a random ceramic fiber reinforced, high temperature capable metallic material. Random ceramic fiber reinforced metallic and other ductile materials can also be cold sprayed.

BRIEF DESCRIPTION OF THE DRAWINGS

FIG. 4*b* shows an example of how the particle size distribution required for the successful cold spray deposition of brittle materials can be achieved by using from two to ten different material compounds with each material having a different chemical composition and material properties.

FIG. 7*a* shows a sample made using a mixture of two different p-type thermoelectric semiconductor material powders. FIG. 7*b* shows a sample made by combining a semiconductor powder, diamond powder, and a small percentage of metal powder.

Successful cold spray deposition of brittle materials requires a wide range of particle sizes and three dimensional shapes for the mechanical interlocking process to yield high density and mechanically rigid deposits. Brittle particles with large aspect ratios such as ceramic or carbon fibers can be included in the powder mix, and the powder then cold sprayed into a random fiber reinforced composite material.

Figure 8A:
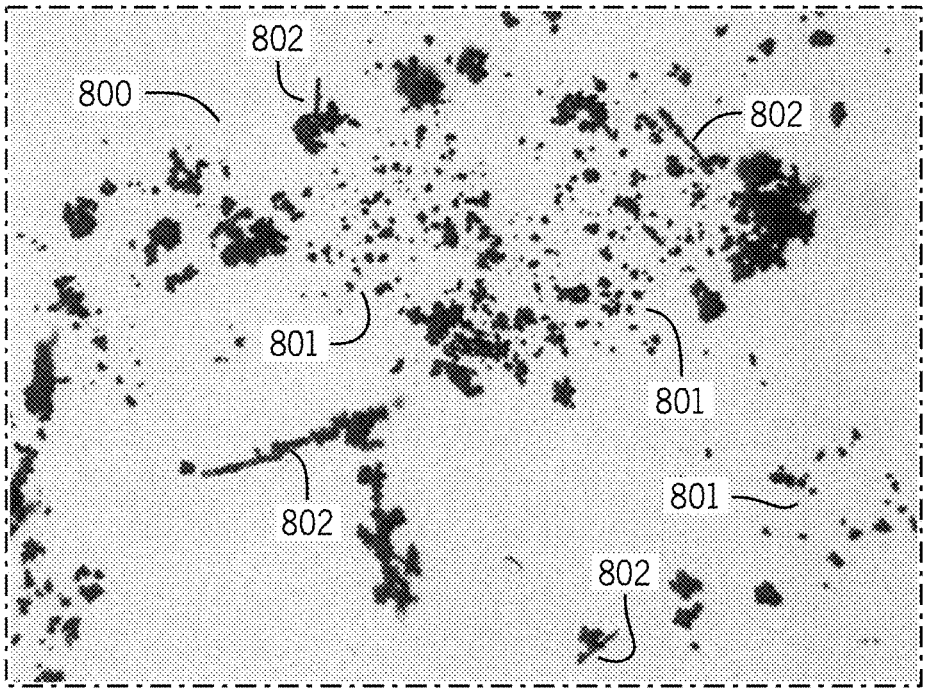
Figure 8B:
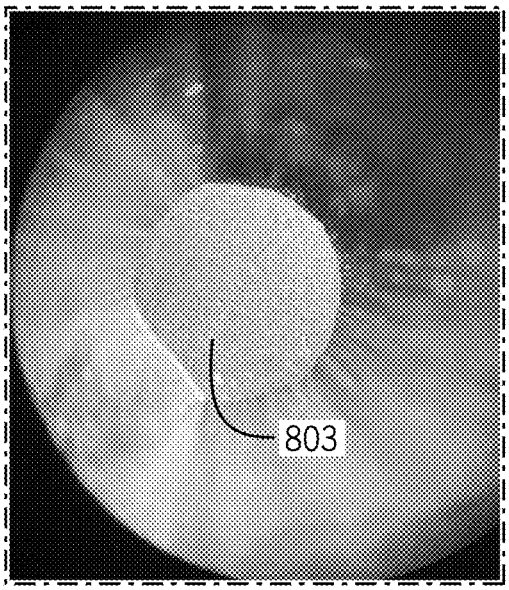

FIG. 8*a* shows how high aspect ratio amorphous silica micro-fibers can be incorporated into a brittle particle semiconductor powder mix for mechanical, structural or other functional property enhancement of the cold spray deposited composite material. FIG. 8*b* shows the polished surface of a cold spray deposited bismuth telluride, amorphous silica microfiber powder mix.

The brittle particle cold spray process occurs as a result of the mechanical interlocking and impact densification of the various size and shaped particles. Successful deposition of many different functional classes of brittle materials has been achieved when the particles are irregular in shape and the particle sizes are in a specific volumetric distribution that spans the size range from approximately 100 nm to 15 μm in equivalent spherical dimension. A unique aspect of the process is that some or all of particles below 1 μm in size do get through the supersonic shock layer above the deposition surface and are not all swept away by the expanding gas stream. SEM analysis of cold spray deposited brittle materials clearly show that particles as small as 100 nm are part of the deposited materials and that those nominally 100 nm sized particles fill the gaps between the larger particles, and contribute to the mechancial strength of the deposited material.

Recent research has demonstrated that brittle material particles as small as 5 nm can be added into the brittle material powder and the mixed powder can then be successfully cold spray deposited into layers from 20 μm to centimeters in thickness that incorporate those nanoparticles within the body of the parent single compound or multicoumpound brittle material. Very narrow size range nano particles of different chemical compounds ranging from 5-70 nm in particle size have been demonstrated in weight concentrations from less than 1% up to 20% of the total powder weight.

Figure 9A:
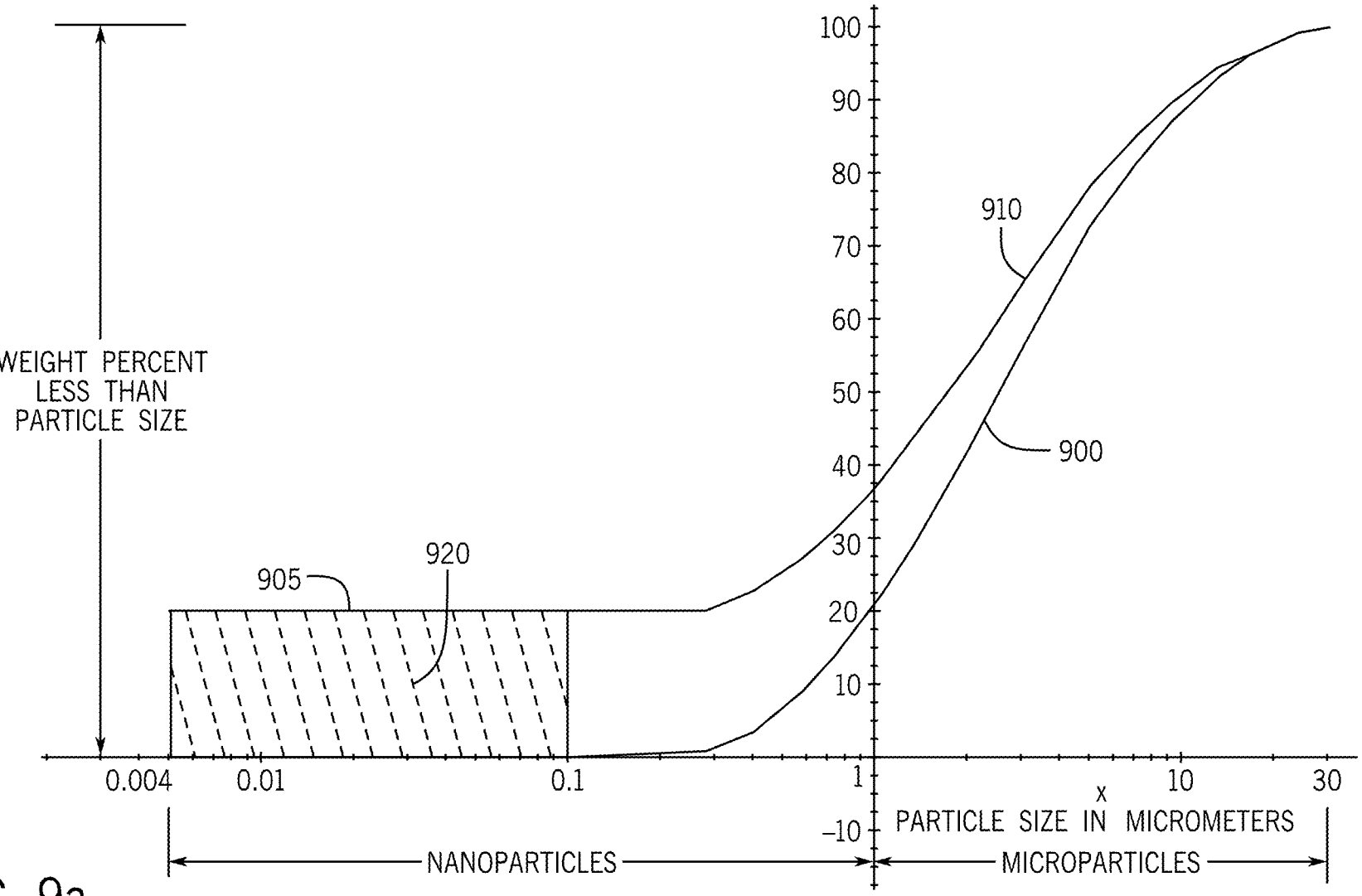
Figure 9B:
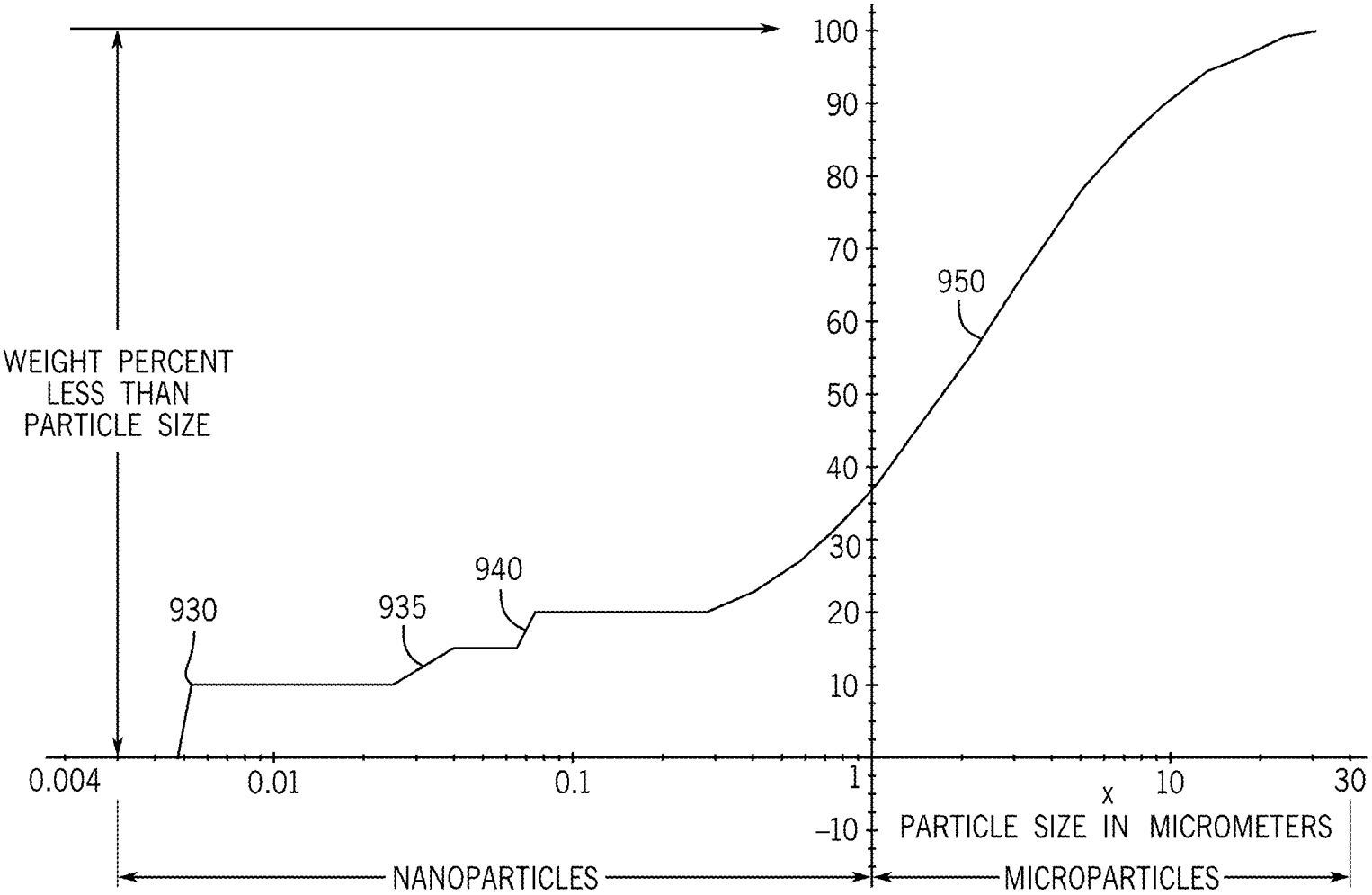
Figure 9C:
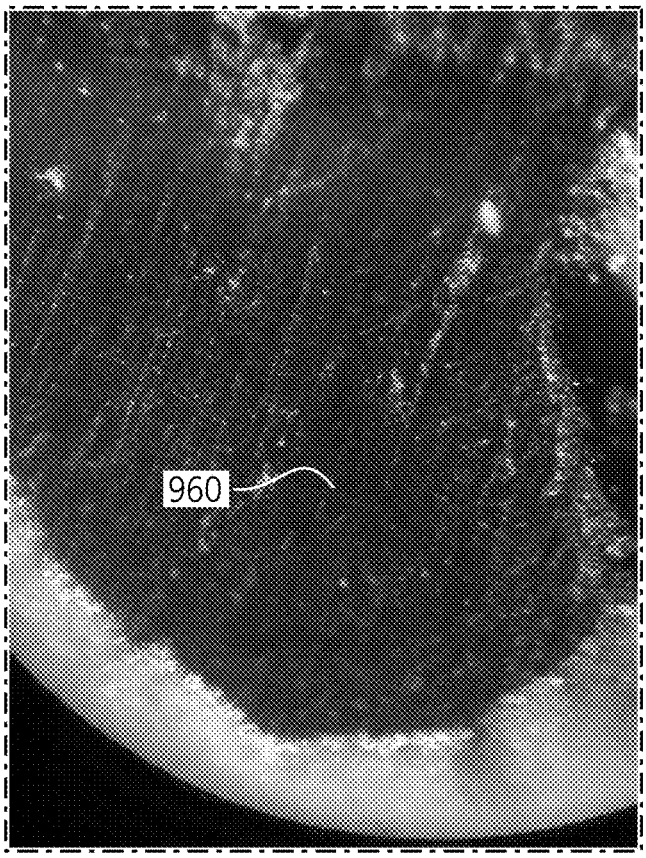

FIG. 9*a* shows a graphic depiction of an example of that particle size expansion down to 5 nm and how that 20 weight percent of material could be composed of 5 nm sized particles. FIG. 9*b* shows an example of how that material addition can be achieved using one or more different nanosized particles and materials. FIG. 9*c* shows the abraded surface of a cold sprayed deposited mixture of a semiconductor material powder with particle sizes from 100 nm to 15 μm and synthetic diamond powder with a nominal particle size of 5 nm.

DETAILED DESCRIPTION

Recent innovations as described in the referenced patents have expanded the application of supersonic cold spray technology to enable the thick layer or bulk material deposition of brittle or non maleable materials without the need for a metal or any binder materials in the powder mix. This branch of cold spray technology is now generally referred to as Brittle Particle Cold Spray or BPCS. Supersonic cold spray of 100 percent pure brittle material particles has been demonstrated on a wide variety of thermoelectric semiconductor materials, hard and soft magnetic materials, and ferroelectric materials, and research has shown that BPCS technology applies to brittle materials in all functional material groups with a wide range of chemical compositions and material properties.

Research covered within this application significantly expands the applications and technology for brittle particle cold spray technology by demonstrating that muticompound brittle materials composed of from two or greater different chemical compounds, random fiber composite ceramic materials where high aspect ratio ceramic or other fibers are incorporated into the brittle material powder mix, and single compound and multicompound brittle materials incorporating nanoparticles as small as 5 nm can be deposited using supersonic cold spray technology.

Figure 1:
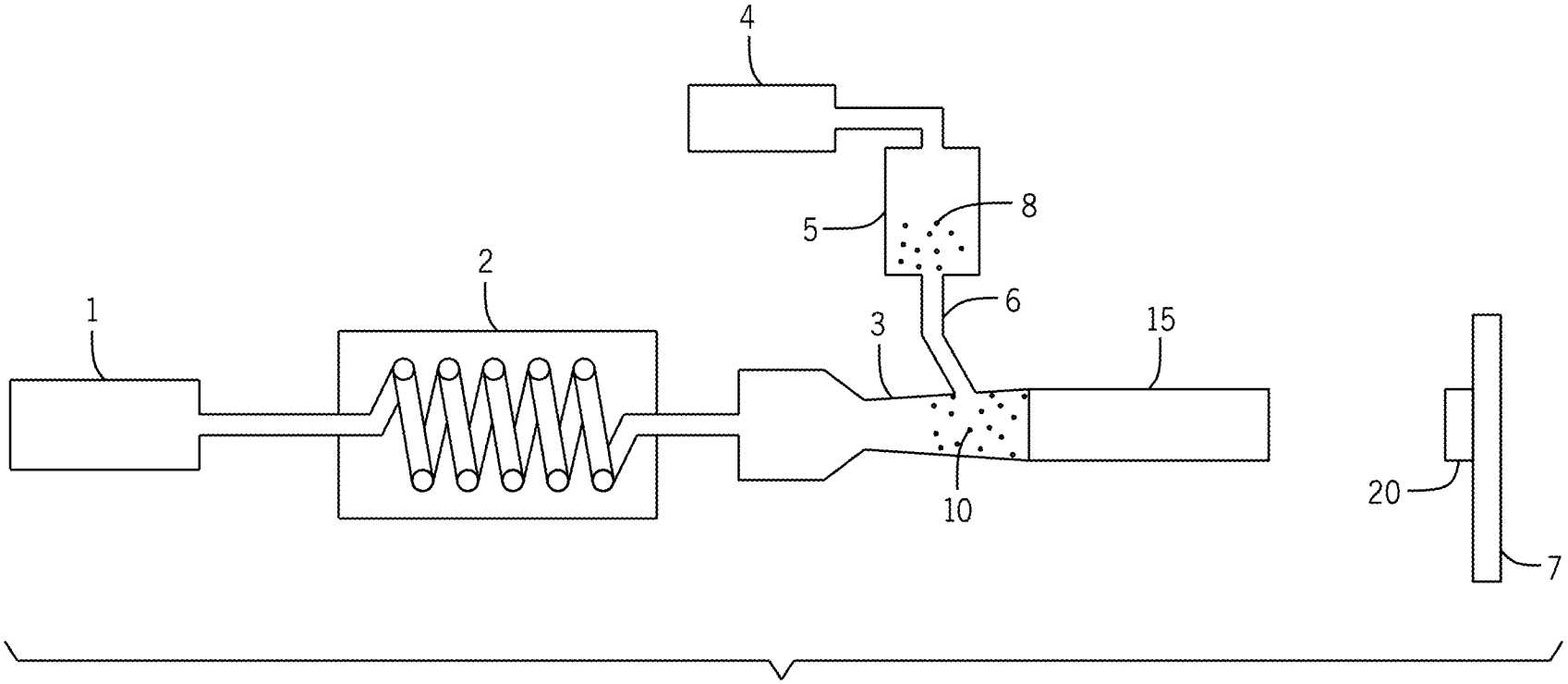
FIG. 1 shows a diagram representing the TTEC LLC low pressure supersonic cold spray system that has be used in the deposition of brittle materials and nano structured, microstructured and composite brittle material compounds

FIG. 1 is a high level diagram of the TTEC LLC low pressure cold spray system that has been used for the cold spray deposition of brittle materials. A gas 1 such as air, nitrogen, helium or a mixture of gases is pressurized in the range from 0.25-1.0 MPa. This pressurized gas 1 is directed into a heater 2 and is heated to 100-650 degrees centigrade. This gas is then directed through a converging-diverging nozzle 3 with a throat diameter between 1.0 millimeter and 2.5 milimeter where the gas is accelerated to supersonic velocity. In this version of a cold spray system, a low pressure gas 4 normally air or argon at atmospheric pressure is fed into a powder feeder 5. The powder feeder 5 contains a powder composed of irregular shaped brittle particles 8 in a size range from 5 nm to 15 micrometers in equivalent spherical diameter. The low pressure gas 4 combines with the irregular shaped particles 8 and carries them through the powder entrance tube 6 inserted at an angle into the diverging section of the converging diverging nozzle 3 where it mixes with the gas 1 that has been accelerated to supersonic velocity. The brittle material particles 10 accelerated within the supersonic gas flow are directed via 15 a constant diameter nozzle extension toward a substrate 7 where they are deposited as a coating 20 on impact.

Single component powder materials that have been used used successfully in Brittle Particle Cold Spray or (BPCS) are composed of irregular shaped particles with equivalent spherical sizes ranging from approximately 100 nanometers to 15 micrometers in size when measured using a Mastersizer 2000/3000 Laser Diffraction system with a dry dispersion technique or when viewed using high power SEM imaging.

Figure 2:
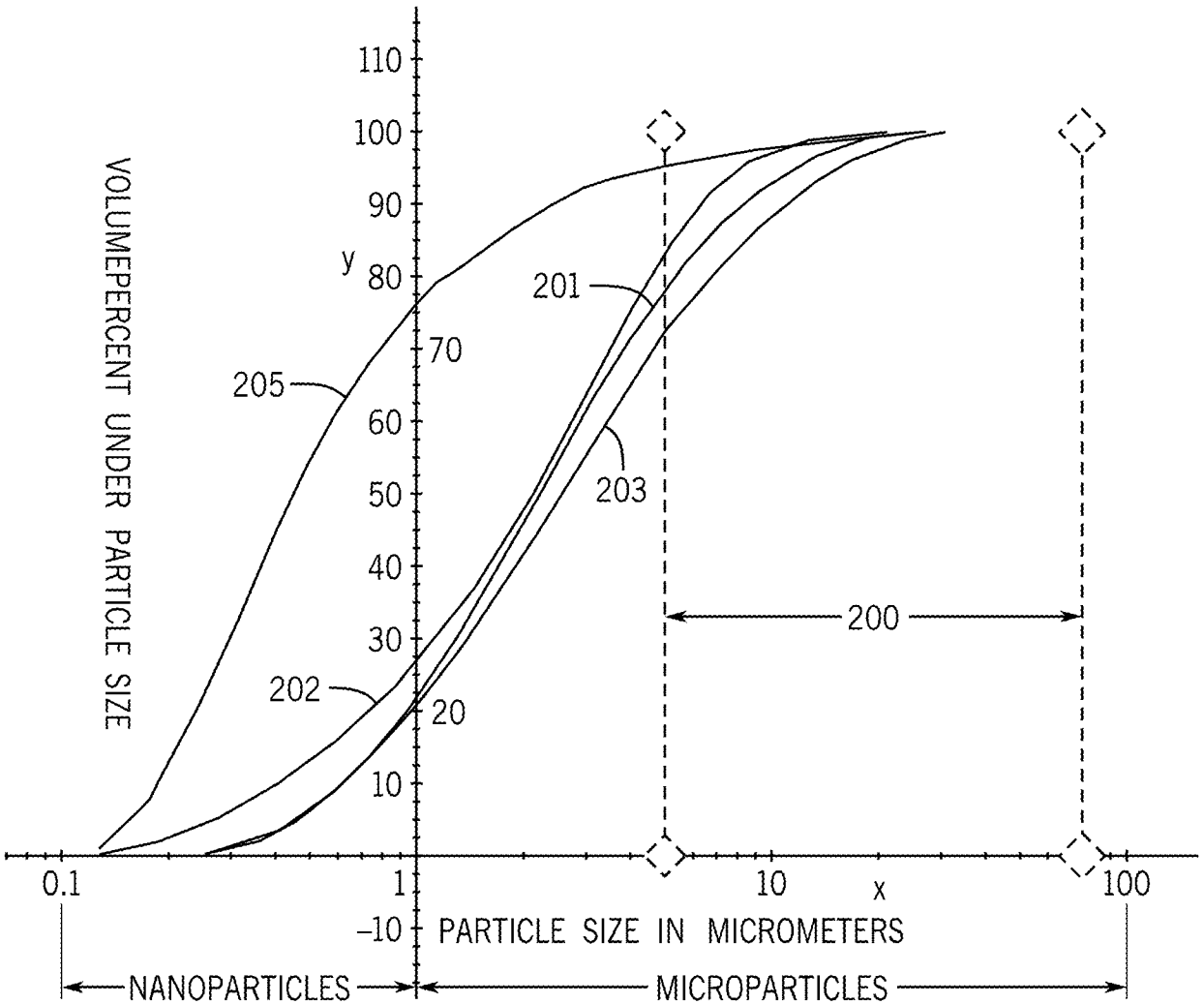
FIG. 2 is a diagram that shows examples of particle size distribution curves for several different single compound brittle material powders that have been successfully cold sprayed compared to the particle size ranges normally used in metal cold spray technology. These curves represent successful depositions of 100% brittle material particles of piezoelectric compounds, thermoelectric semiconductors, and hard magnetic materials.

FIG. 2 shows a graphic depicting the particle sizes and the particle size distributions for both metal and brittle materials that have been used in the supersonic cold spray deposition process. Metal cold spray particles are normally spherical in shape and the particles uniform in size with the particle size 200 within the range from 5 to 70 μm dependant on the material being sprayed and the cold spray system operating parameters. Metal particles deform and splat when they impact the surface and then fuse to the substrate and to each other. The nominal particle sizes required for successful cold spray of pure 100% brittle material powders that do not include a binder of any type are much smaller than those used for ductile metal and ductle polymer cold spray, and a specific particle size distribution is required which has been shown to span from 100 nm to 15 μm in equivalent particle size as measured using a Mastersizer 2000/3000 Laser Diffraction system with a dry dispersion technique. Even small quantities of particles greater than 20 μm in size can disrupt deposition of brittle material powders and particles of that size will scour the surface of previously deposited material. Brittle material particles must also be irregular in shape in all three dimensions for the particle mechanical interlocking process to occur. Brittle semiconductor material powders such as a P-type bismuth telluride with particle size distribution 203, and an N-type Antimony Telluride with particle size distribution 201 can be successfully cold sprayed when the particle size distributions are as shown. Magnetic material powders such as Neodymium Iron Boride can also be cold sprayed using a similar particle size distribution 202 when using nitrogen gas and the same TTEC cold spray system operating parameters of 500° C. gas temperature and 100 psi gas pressure. The 201, 202, and 203 particle size distribution (PSD) curves represent target PSD values and ranges for all single component brittle material powders used in the Brittle Particle Cold Spray (BPCS) process. While 201, 202, and 203 represent the desired PSD values for the successful cold spraying of a wide range of brittle materials, commercial powders are not available with this required particle size distribution and irregular shape morphology. The powders with 201, 202, and 203 PSD values were made using a high energy planetary milling process of commercially available billets of material or powders with larger average particle sizes. Different milling parameters and milling times are required for each brittle material compound. Barium Titanate has been cold spray deposited using a powder with the particle size distribution 205 that includes a much greater percentage of nanoparticles in the mix, but the range of the particle sizes required for deposition remained within the range of 100 nm to 15 μm. The use of Helium gas was necessary to achieve the higher gas and particle velocities for this material to deposit.

The BPCS process requires specific particle size distributions to enable a tight mechanical interlocking of the brittle material particles of different sizes and subsequent densification upon impact of additional particles as the buildup process proceeds from micron level thickness up to centimeters in material thickness. Research has shown that specific amounts of both 100 nanometer to 1 μm sized particles are required, and that particles in the 5-10 μm particle size are also required for near theoretical density depositions.

Figure 3A:
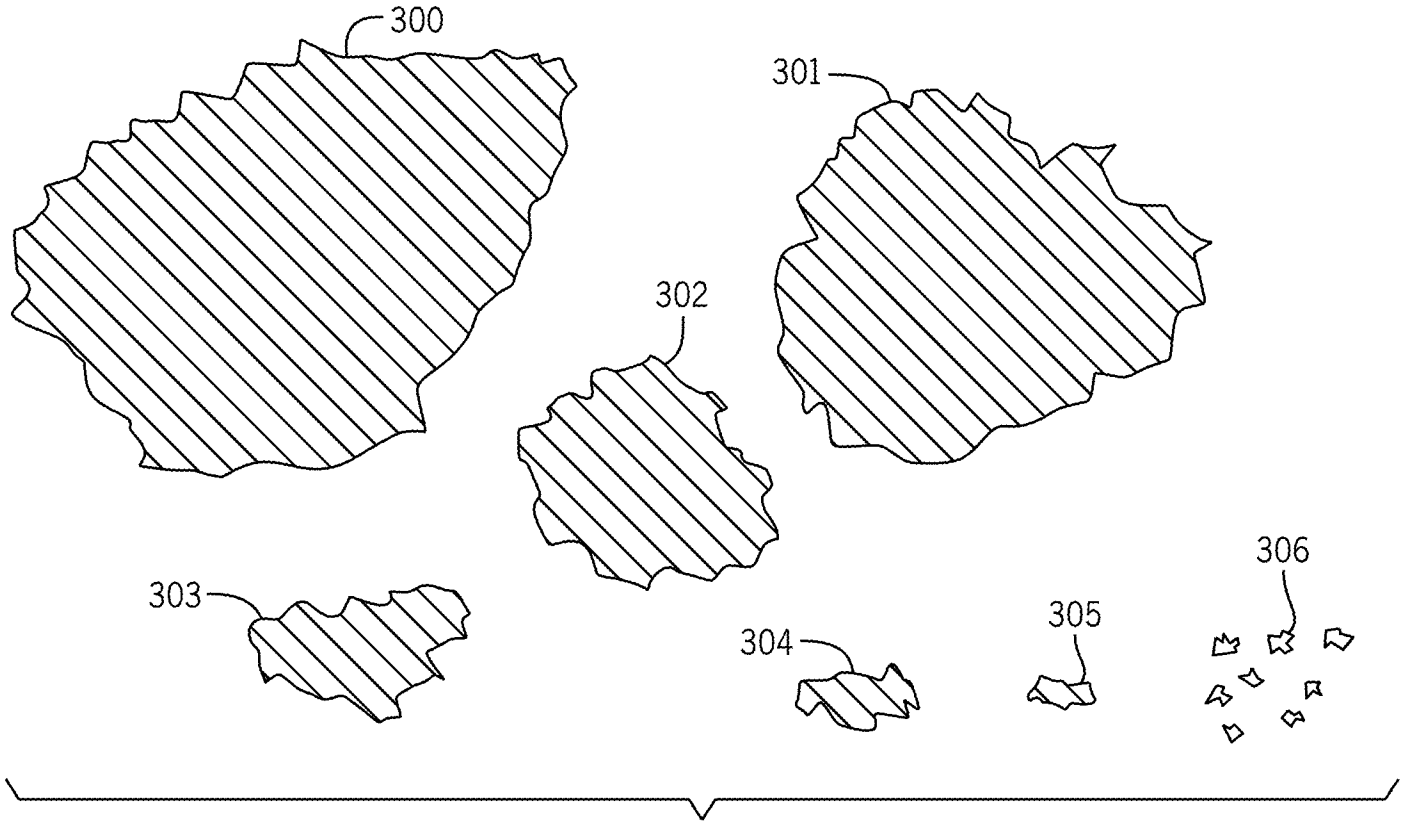
FIG. 3*a* is a graphic depicting the irregular shapes and the range in particle sizes from 100 nm to approximately 15 μm that have been used successfully for the cold spray deposition of 100% single compound brittle functional material powders.

FIG. 3*a* shows a graphic depicting the relative shapes and particle size range which are necessary for the deposition of dense material layers greater than 200 microns in thickness using the brittle particle cold spray process for 203, a P-type bismuth telluride. While a 10-20 volumetric percentage of 300 particles in the size range of from 8-15 μm can be present in the cold spray powder, when the particle size is measured using a Mastersizer 2000/3000 Laser diffraction system, then numerically 99.99% of the particles are smaller than approximately 8 μm in equivalent spherical size. The range in particle sizes in 203 from 15 μm down to 100 nm is represented by the 300, 301, 302, 303, 304, 305, and 306. Numerically, greater than 96% of the particles in the 203 powder are less than 1 μm in equivalent spherical size.

Figure 3B:
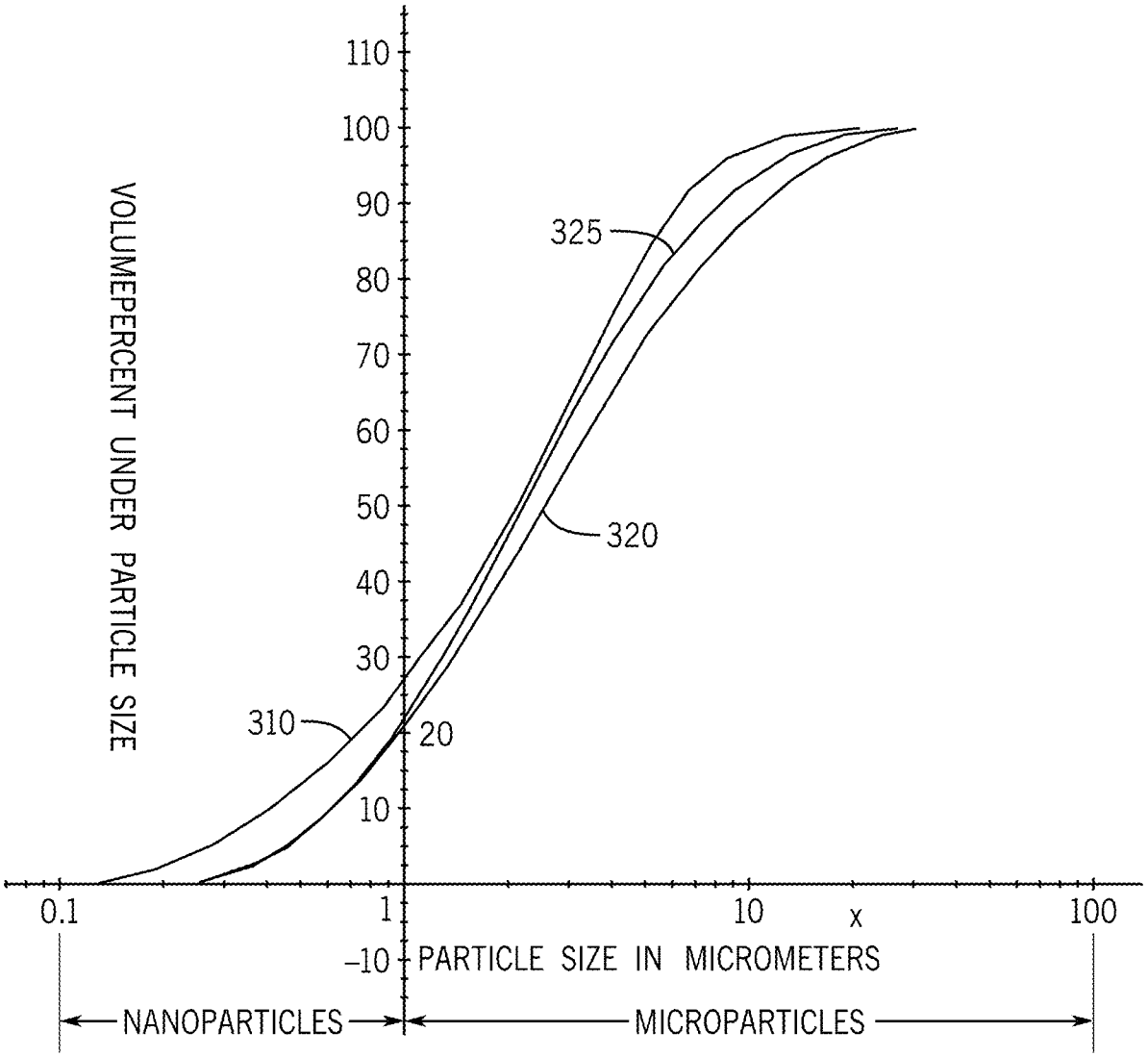
FIG. 3*b* is a graph showing two particle size distribution curves that have been used to successfully cold spray two different brittle material compounds, a bismuth telluride thermoelectric semiconductor and a neodymium iron boride hard magnetic material. Powders of these two materials can be mixed together in any ratio as represented by a non exclusive intermediary line and the resulting mixed 100 percent brittle material compound powder can be successfully cold sprayed into layers of from 20 μm to centimers in thickness.
Figure 3C:
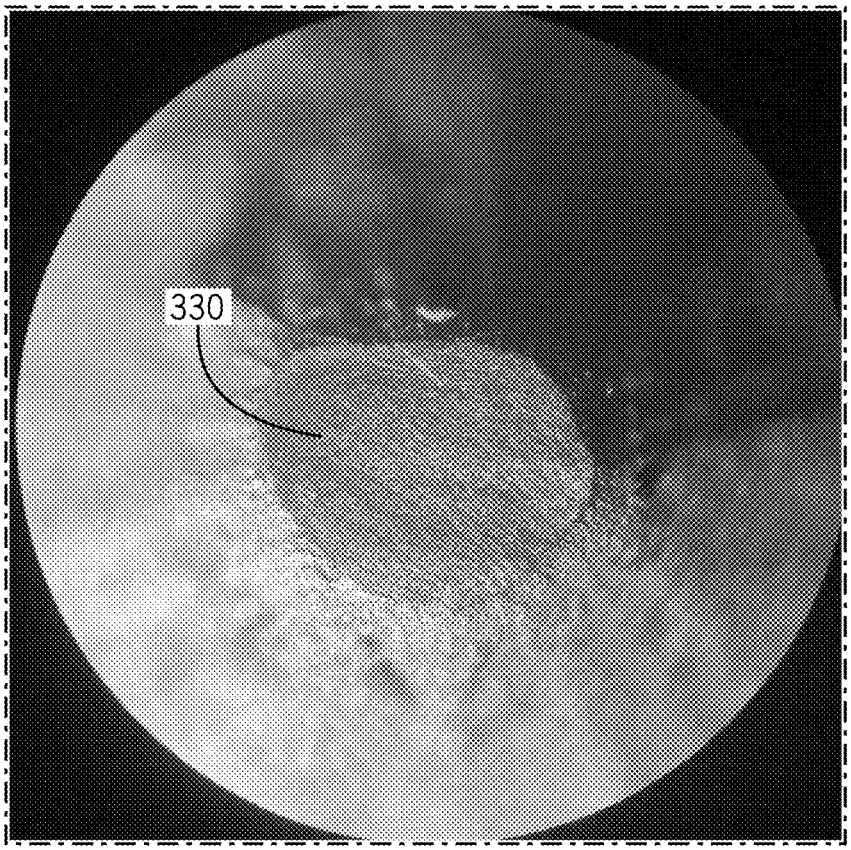
FIG. 3*c* shows the 5000 grit abraded surface of a cold spray spot deposit made using a 50/50 by weight mix of these two materials.

FIG. 3*b* shows the measured volumetric particle size distribution 310 in a Neodymium Iron Boride magnetic material powder created by planetary ball milling a Neo Magnaquench MQFP-B-20441-089 powder, and 320, a P-type bismuth telluride powder that was manufactured by TTEC LLC by planetary ball milling sections of a polycrystalline billet made by Everredtronics Corp. Individually each of these powders can be cold sprayed using nitrogen gas at a 500° C. gas temperature and 100 psi gas pressure using the TTEC cold spray system. The Brittle Particle Cold Spray mechanical interlocking process has been shown to be relatively insensitive to the composition of the material being sprayed. This unique aspect of the BPCS process, therefore, enables mixing powders made from different chemical composition materials but with each material having a similar particle size distribution and then spraying the composite material powder with the approximate particle size distribution 325 as shown. This ability to cold spray deposit mixed powders composed of different material compounds from the same or different functional material classes creates unique materials with functional properties which are different that either of the materials in the powder mix FIG. 3*c* shows 330 a 5000 grit abraded surface of a cold spray deposited 50/50 weight percent mix of the 310 Neodymium Iron Boride magnetic material powder and the 320 Bismuth telluride powder. More detailed evaluation is underway, but the combined thermoelectric semiconductor/magnetic material deposit exhibited a similar Seebeck response to a cold sprayed sample of the 320 bismuth telluride alone, and the measured resistance of the composite material is significantly lower than the measured resistance of either of the cold sprayed component materials alone.

Near theoretical density material depositions have been demonstrated for a wide range of multicomponent brittle material functional types with up to five different material compounds in the powder mix. Deposited material layers of multicomponent powders can vary from twenty micrometers to greater than a centimeter in thickness with material deposition rates exceeding centimeters in thickness per minute, and measured deposition efficiencies up to 30% and potentially higher. The weight percentages of each material in the brittle material powder mix can vary as long as the particle size distributions of each of those materials are similar and the volumetric particle size distribution of each component material within the powder spans the two orders of magnitude equivalent volumetric spherical size range from 100 nm to 10 μm. This ability to cold spray mixed powders of different chemical compounds and with different weight percentages as long as the particle size distributions are similar also enables the ability to cold spray brittle materials that gradually transition from one brittle material compound to another through the thickness of the material.

In addition it also allows the mixing of ductile materials such as metals or polymers into the powder mix and the gradual transition from a cold spray process which is controlled by mechanical interlocking of brittle particles to a cold spray deposition process that is controlled by the ductile behavior of the metal or polymer component of the powder mix.

Additional research has demonstrated that the Brittle Particle Cold Spray (BPCS) process can also be used to spray thick layer depositions of combined brittle material powders where the required total particle size distribution from 100 nm to 15 μm is determined by combining multiple brittle material chemical compounds and functional types, but with each material's particles constrained to a specific particle size range and particle size distribution within the total particle size range required for the mechanical interlocking process and densification to proceed.

Figure 4A:
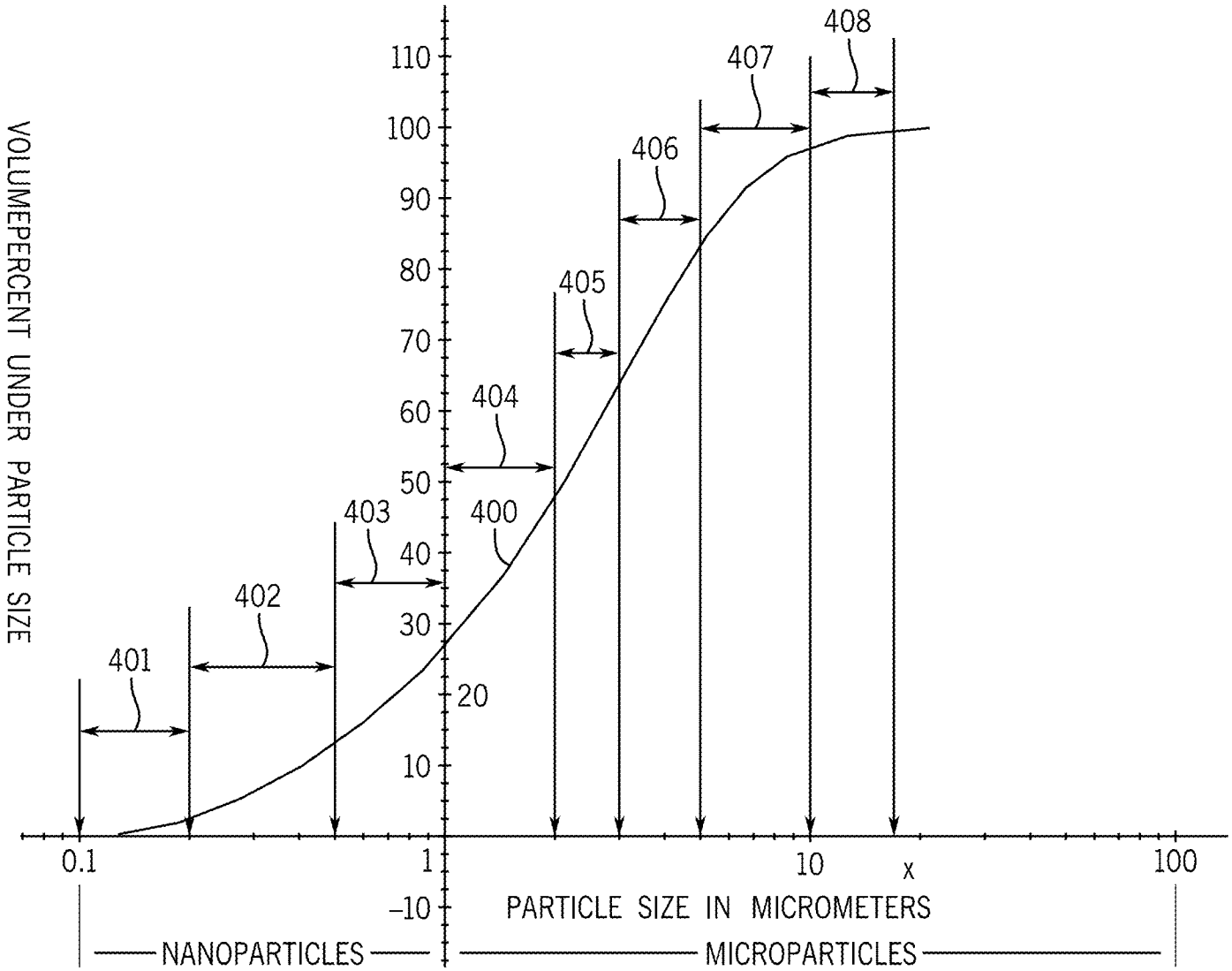
FIG. 4*a* shows how a typical particle size distribution that has been used for the successful cold spray deposition of single compound thermoelectric semiconductors and hard magnetic materials can be broken down into a set of discrete particle size ranges. Shown, but not limited in number or individual range, is an example of how that particle size range can be partitioned into eight separate particle size ranges with each range contributing a specific volumetric percentage to the total powder. Each of these example ranges in particle size and volumetric content can be composed of a different chemical compound that when mixed together result in a particle size distribution of the combined powder composed of brittle materials which can be cold spray deposited.

FIG. 4*a* shows 400 a particle size distribution for a brittle particle cold spray powder which has been shown to produce successful deposition of a wide set of different functional classes of brittle materials, including different chemical composition semiconductors and different chemical composition hard magnetic materials. This particle size range 400 for example, but not limited to, can be binned into separate 401, 402, 403, 404, 405, 406, 407, and 408 particle size and volume percentage bins. Each bin represents the size distribution and volume percentage of particles within that size range that when combined results in successful cold spray deposition of the brittle functional material powder. This disclosure does not require a specific number of separate bins nor does it limit the number of separate bins that can be used for successful cold spray deposition. The irregular shaped particles contained within each size bin can be composed of particles of a single brittle material or two or greater different chemical composition brittle materials. When the powders covering all of the bins are combined in the correct volumetric proportions and thoroughly mixed, then the combined brittle particle powder closely reproduces the entire 400 particle size versus the volume percent under particle size curve and the powder can be cold sprayed. As example, two or more brittle compound materials with each material having particles within each of the 401, 402, 403, 404, 405, 406, 407, and 408 particle size bins with the size distribution and volumetric amounts shown within those bins can be mixed together with the resulting powder having substantially the same particle size distribution as 400. In addition, individual brittle materials within a mix of brittle functional material powders can have particles in from one to all eight of these example size bins such that when the brittle material particles of the different chemical compounds consisting of different sizes and size distributions are mixed, then the mixed powder exhibits essentially the 400 particle size distribution and can be cold sprayed.

Figure 4B:
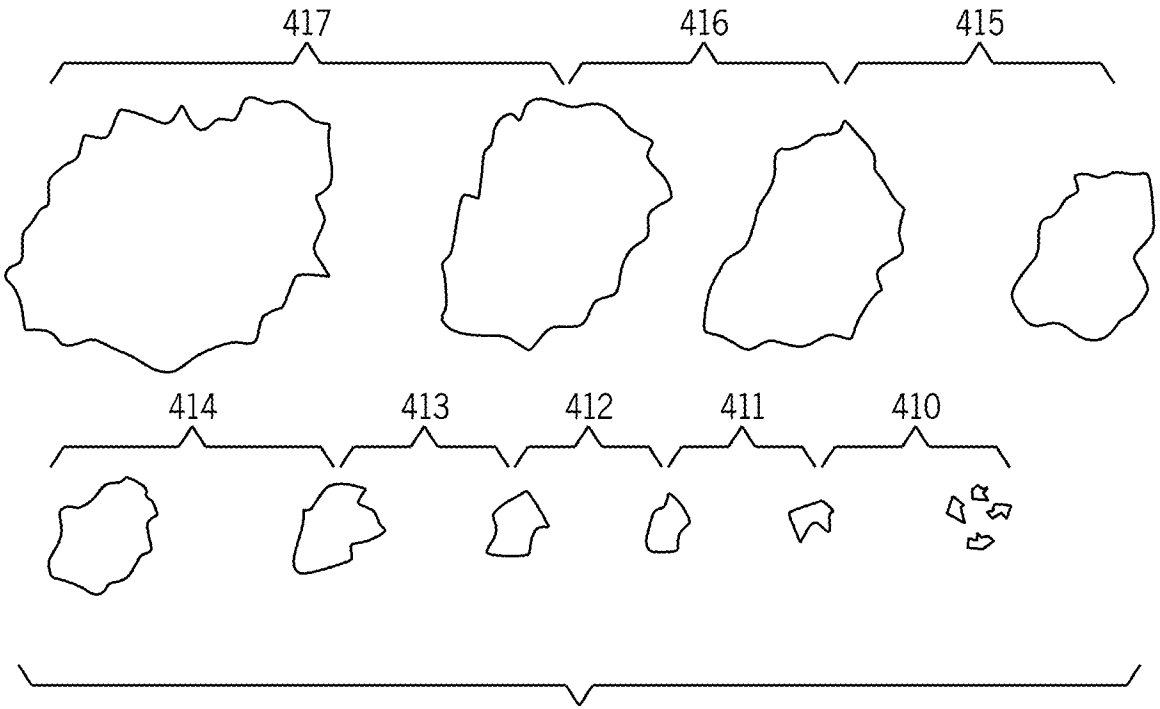
FIG. 4*b* shows an example of segregating a brittle particle cold spray powder into specific particle size ranges with each size range potentially being allocated to a different chemical compound with unique properties.

FIG. 4*b* shows another way to visualize the binning of materials within a particle size range where 417 represents the particles and particle sizes of one material compound and 416, 415, 414, 413, 412, 411 and 410 each represent the particle size range of other brittle material compounds. As shown, the material mixtures can be composed of powders from two or more material compounds and where each compound is partitioned within a particle size range.

Figure 5:
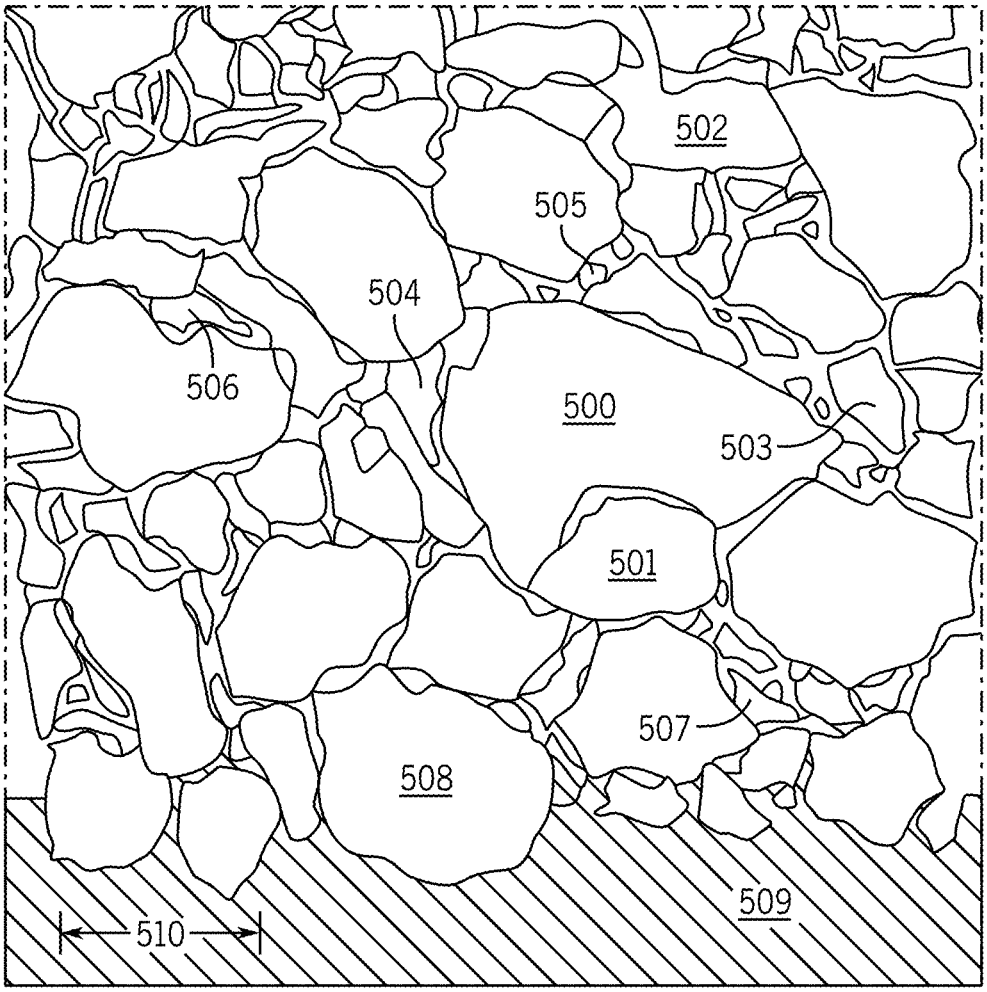
FIG. 5 shows how a mix of different size and shape brittle functional material particles can embed into the substrate surface and then interlock together during the supersonic cold spray process to form a dense, rigid material coating or bulk material deposition that can range from 20 μm to centimeters in thickness. Because the deposition process is due to mechanical interlocking, these particles can be composed of the same or different chemical compounds.

FIG. 5 shows how a particular mix of different brittle functional material particles 500, 501, 502, 503, 504, 505, 506, 507 and 508 can first embed into the substrate surface 509 and then mechanically interlock together during the supersonic cold spray process to form a dense, rigid material coating or bulk material deposition up to centimeters in thickness. 510 represents a one to two micron length. A complete understanding of the brittle particle to brittle particle mechanical interlocking and densification process has not been developed, but high magnification SEM images have shown that the irregular shape of particles as small as 100 nm is maintained during the deposition process.

Achieving the specific particle size distributions (PSDs) 201, 202, 203, and 205 as shown on FIG. 2 for successful cold spray deposition is challenging for many brittle materials. Material hardness, crystal type, the availability of precursor powders or other precursor material forms and numerous other factors all influence the particle size distribution that can be achieved when using any specific particle sizing method. High energy ball milling using an Across International planetary mill with alumina jars and alumina balls has worked for a number of different thermoelectric semiconductor materials and magnetic materials, but has not been successful for all brittle materials. Tungsten carbide jars and Tungsten carbide balls have been successfully used for other materials. Achieving the correct particle size distribution such as 400 with irregular shapes and sizes of less than 1 μm is difficult.

Figure 6A:
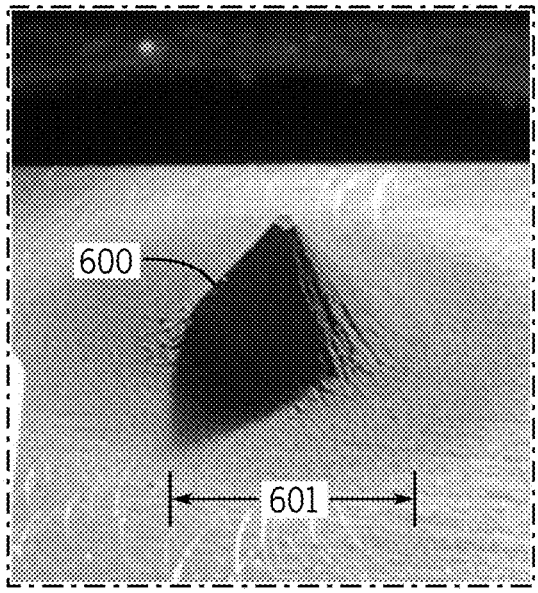
FIG. 6*a* shows a thick layer cold spray deposited sample of a material composed of a mixture of a sulfur semiconductor particles in the size range from approximately two to ten microns and synthetic diamond particles in the size range from 0.1 to 2.0 microns.
Figure 6B:
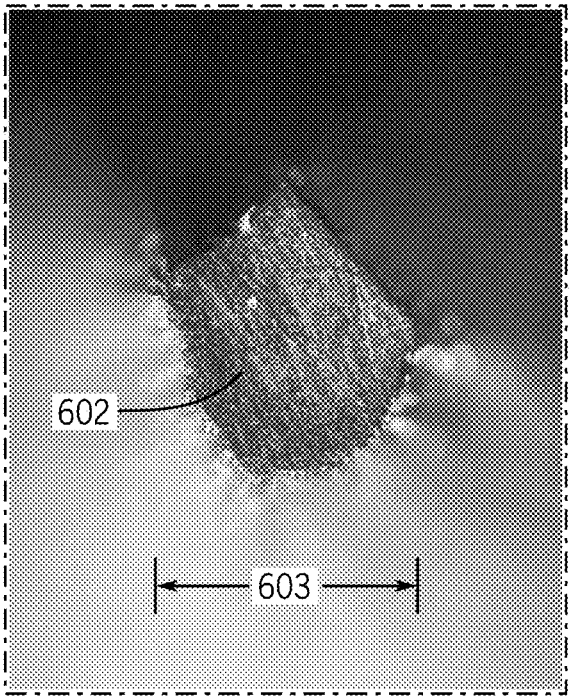
FIG. 6*b* shows the uniform interior of the sample shown in FIG. 6*a* after being surface abraded using 5000 grit paper.

FIG. 6*a* shows 600, a thick layer cold spray deposited sample of a compound material 601 approximately 0.6 cm in diameter, and 0.5 cm in height. The cold sprayed material is composed of a mixture of a sulfur semiconductor with irregularly shaped particles in the nominal size range from two to fifteen microns that could not be successfully cold sprayed and irregularly shaped synthetic diamond particles constrained within the size range from 0.05 to 2.0 microns that when mixed together had essentially the 400 particle size range and distribution FIG. 6*b* shows a 200× photo of the uniform interior of the mixed material deposited sample 602 shown in FIG. 6*a* after being surface abraded using 5000 grit paper. The very dense, well consolidated cold sprayed sulfur semiconductor and synthetic diamond material composite 602 is demonstrated 603 by the appearance of the abraded surface Since materials with diverse material properties such as 600 a sulfur based semiconductor with particle sizes in the D(10) to D(90) range from approximately 2-15 microns, and synthetic diamond particle with particle sizes in the D(10) to D(90) range from 0.05-2.0 microns can be mixed and then successfully sprayed using the BPCS process, this mix-and-match capability of combining both material types and particle size distributions enables the formation of cold sprayed material compounds with unique, thermal, electrical, chemical, optical and structural properties.

A specific but not inclusive application example of this mixing brittle material powders that individually fall within all or part of the required particle size distribution range, is mixing two or more different thermoelectric semiconductor materials with the objective of widening the Seebeck coefficient versus temperature response curve of the compound material to improve the bulk material thermoelectric Figure of Merit for a particular thermal operating environment, or the combining of different functional material types such as a neodymium iron boride magnetic material powder with particle size distribution 310 and a bismuth telluride powder with the particle size distribution 320 to create a powder with the approximate particle size distribution or 325, so that the bulk material's properties meet a set of specific required set of chemical, thermal, electrical and magnetic properties.

The ability to mix functional brittle material types, for example includes, but is not limited to, magnetic materials, thermoelectric semiconductor materials, ionic semiconductor materials, ferroelectric/piezoelectric materials, superconducting materials, optical materials, and even structural materials such as silicon carbide and diamond used for surface hardened wear resistant coatings. In addition simulated or actual extraterrestrial soils such as Lunar and Martian soils, when mixed with other brittle materials to achieve a desired particle size distribution over the range of 100 nm to 15 μm can also be supersonic cold spray deposited.

Metal and other ductile material powders in the size range from five microns or below can also be added to the mix in weight percent concentrations not limited to from less than 0.1% to 10% without disruption of the brittle material deposition process.

A unique attribute of this significant expansion of the process and applications for Brittle Particle Cold Spray (BPCS) technology described, therefore, is the ability to combine powders of different brittle functional material compounds and produce thick layer cold spray depositions as long as the the combined particle size distribution falls within a specific particle size distribution.

Figure 7A:
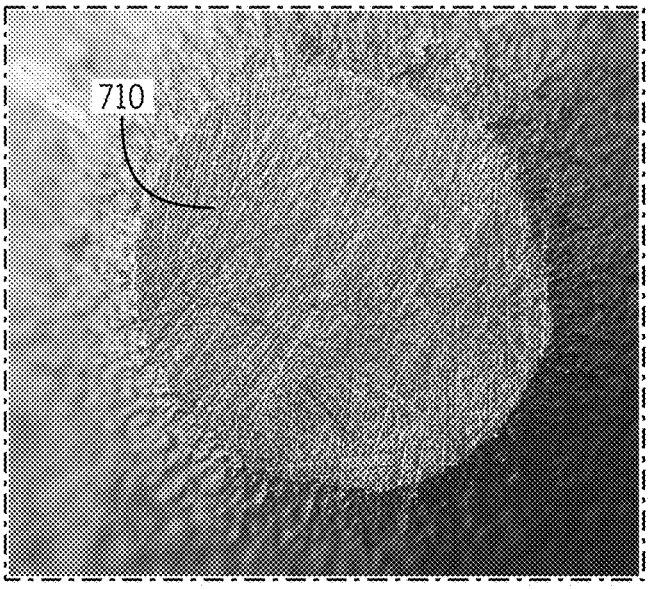
FIG. 7*a* and FIG. 7*b* show examples of the machined surfaces of supersonic cold spray depositions of mixed compound materials.
Figure 7B:
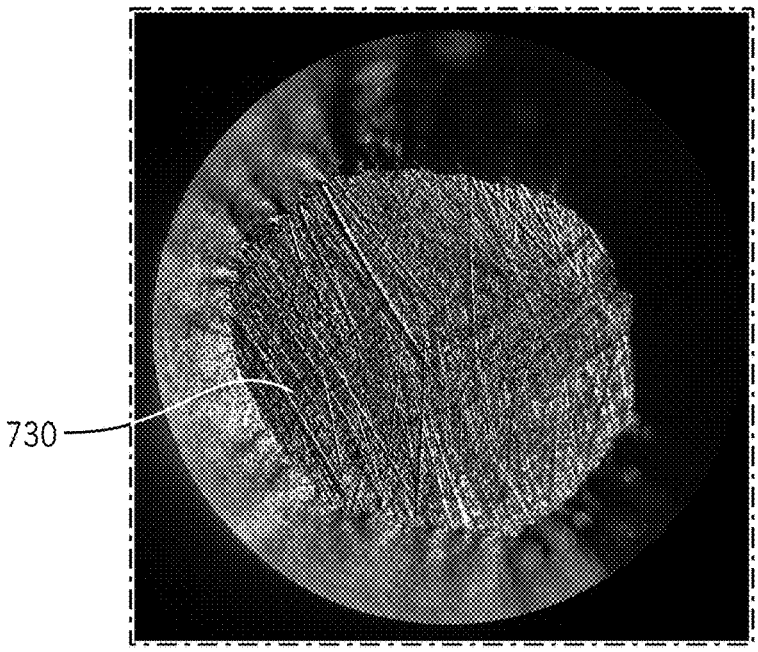

FIG. 7*a* shows 710 the dense, uniform abraded surface of a deposition of a 50/50 mix of a p-type bismuth telluride (BiTe) thermoelectric semiconductor and a p-type silver antimony tellurium germanium (TAGs) semiconductor powder. FIG. 7*b* shows the dense uniform abraded surface 730 of a cold sprayed sample where 80 weight % of the particles are a p-type semiconductor spanning the entire particle size range from 0.1 μm to 15 μm, 10 weight % of the particles are synthetic diamond with particle sizes less than 1.0 μm, and 10 weight % are nominal 5 μm diameter aluminum particles. This ability to mix multiple classes of brittle functional materials, and also small amounts of ductile material particles and successfully cold spray the mixed powder opens a wide additional material and product application space for the Brittle Particle Cold Spray supersonic cold spray process.

As described in the referenced patents, the primary factor in the brittle particle cold spray mechanical interlocking process has been shown to be the particle size distribution of irregularly shaped particles. In effect the various shapes and sizes of the particles mesh together and the smaller particles fill the gaps between larger particles. While regular and irregular shaped particles greater than 20 μm in equivalent spherical size have been demonstrated to disrupt that deposition process and scour or sandblast the surface as a result of their much greater kinetic energy at impact, micron sized and sub micron sized particles with very high aspect ratios such as fibers and nanotubes, however, can be added into the powder mix, and the composite mixture then cold sprayed. A coating of powder that is ultimately disposed on a body, as disclosed herein, may include a mixture of elements that are in a set of irregularly shaped elements that includes at least one of a silicon dioxide material, an aluminum oxide material, a zirconium oxide material, a hafnium oxide material, a silicon carbide material, or a boron carbide material. Also, particles in a set of brittle functional material particles included in the powder may be one or a combination of brittle functional material particles selected from a group consisting of a thermoelectric semiconductor material, a piezoelectric semiconductor material, a hard magnetic material, a soft magnetic material, a Lithium Nickel Manganese Cobalt Oxide compound, and a Lithium Iron Phosphate compound.

Research has demonstrated that random fiber Ceramic Matrix Composite (CMC) materials can be made where ceramic material micro and/or nanofibers or carbon microfibers or carbon nanotubes are incorporated as a specific component of the brittle particle powder material mix. Cold spray deposition of materials composed of greater than ninety-five percent of brittle material particles requires a specific particle size distribution, but part of that distribution can be made of materials with large length to diameter ratios such as fibers so that the high aspect ratio particles act as a structural reinforcement for the deposited brittle material. High temperature capable fibers such as fused quartz, mullite, zirconia, carbon fiber and carbon nanotubes can be used, and fibers with length to diameter ratios of greater than 100 have been demonstrated.

FIG. 8*a* shows a 200× photograph of 800 a sample of the individual and agglomerated brittle materials in a mixed compound powder which can be cold sprayed. This powder is composed of 80 percent bismuth telluride brittle particles 801 in the size range from 100 nm to approximately 15 μm, and 20% Johns Manville thermally pre-treated amorphous silica micro-fibers (Q-Fiber) 802 with nominal diameters of 1 μm, and with fiber lengths to 100 μm or greater. Fiber lengths were sized and mixed into the powder by the use of a ½ hour mixing and sizing cycle using an Across International planetary mill. When the resulting powder/fiber mix was cold sprayed using a TTEC LLC low pressure cold spray system, these 802 fibers are incorporated into the material and provide a random fiber structural matrix within the cold spray deposited bismuth telluride FIG. 8*b* shows 803 the machined surface of a composite 80 weight percent bismuth telluride, 20 weight percent random amorphous silica fiber cold sprayed composite.

Similar cold spray deposition testing of random ceramic fiber reinforced materials has been performed successfully with other semiconductor and magnetic materials and other ceramic fiber compositions including zirconia fibers. Research is underway to expand that list to very high temperature capability fiber and higher temperature ceramic materials for advanced thermal protection system applications.

While the innovations described herein pertain primarily to brittle particle materials, the mechanical interlocking deposition process of particles in the 100 nm to 15 μm can also be applied to materials that are considered ductile in nature including pure metals, high entropy metal alloys, and high temperature capability polymer materials such as polyether-ether-ketone and polytetrafluoroethylene. Ceramic reinforcing fibers can also be added to these ductile material powders and deposited using the same process as described for brittle material cold spray deposition.

Johns Manville amorphous silica Q-Fiber is manufactured using a process that removes impurities from the fibers, and that process results in different levels of shrinkage of the fibers when exposed to temperatures from 500° C. to 1100° C. Cold spray deposited random fiber reinforced brittle materials 803 can be made using preshrunk Q-fibers 802 and/or Q-fibers that will shrink when exposed to temperatures greater than 500° C. Cold spray deposited random fiber reinforced materials fabricated using the non-preshrunk Q-fiber can therefore be exposed to temperatures during the cold spray deposition process or post the cold spray process that results in shrinkage of the fibers. Shrinkage of the randomly oriented fibers places the cold spray deposited composite material in compression and pre-stresses the deposited material. This fiber shrinkage process can be used to improve the structural capability of random fiber reinforced composite materials for some applications.

The mechanical interlocking process of the brittle particles during cold spray deposition has been demonstrated to enable the addition of a wide range of ceramic and other types of microfibers into the brittle particle powder mix which then are incorporated into the cold sprayed material during the cold spray process. Ceramic microfibers fibers such as fused quartz, mullite, and zirconia, carbon fibers, and carbon nanotubes can be used to create high temperature capable random fiber ceramic matrix composite materials for thermal protection and other applications.

Research by the inventor has shown that single compound and multicompound brittle particle material powders with particle size distributions which are substantially similar to 200 can be further modified by the addition of nanoparticles in the size range from 5 nm to 70 nm. Powders with added nanoparticles in the 5-70 nm size range can be cold spray deposited with up to but not limited to twenty weight percent of the same or different chemical composition nanoparticles being added into the brittle particle powder mix. The nanoparticles can be brittle ceramic materials, carbon, diamond, and/or nano scale metal particles. Moreover, at least two different brittle functional materials may include a functional ceramic material including at least one of a silicon dioxide material, an aluminum oxide material, a zirconium oxide material, a hafnium dioxide material, a silicon carbide material, a boron carbide material, or a diamond material, wherein the functional ceramic material having a melt temperature above 2000° C.

Various inter-particle forces cause agglomeration or loose sticking together of irregular shaped brittle particles in cold spray powders 200 where the brittle particle sizes vary from approximately 5 nm to 15 μm in equivalent spherical size. In FIG. 8, 802 shows how both small microparticles and nanoparticles adhere to each other and to an amorphous silica fiber that has been added to the powder mix. This agglomeration also applies to very small particles in the size range from 100 nm down to 5 nm. When brittle material particles in the size range from 5 nm to 70 nm are added to brittle particle cold spray powders such as 200, 201, and 202, and the mix is then cold sprayed, a portion of these very small nanoparticles adhere to the larger particles in the powder and are carried to the deposition surface and incorporated into the cold spray deposited material.

FIG. 9*a* shows, 900 the weight percent particle size distribution of a P-type bismuth telluride powder that has been successfully cold sprayed. Particle size testing of that powder using a Mastersizer 3000 laser diffraction system indicated that there were no particles smaller that 100 nm in the powder. Particles of the same material or other material compounds with particle sizes from 5 nm to 100 nm 920 can be added to the 900 powder and the powder mix can be successfully cold sprayed. Up to 20 weight percent, 905 of nanoparticles in the 5 nm to 100 mn can be added to the original powder resulting in a theoretical cold spray powder with the particle size distribution, 910 shown.

This ability to incorporate very small nanoparticles in the brittle particle cold spray powder mix enables nano-doping or nano-structuring of the cold spray deposited brittle material. FIG. 9*b* shows an example of nano-structuring with different chemical compounds where 930, ten weight percent of Carbodeon Corp Amine P 5 nm synthetic diamond particles, 935, five weight percent of Nanjing XfanO 30 to 45 nm conductive carbon black particles, and 940, an additional five weight percent of 70 nm Cabosil Fumed Silica particles have been added to the bismuth telluride powder with the particle size distribution 900, creating a powder with the theoretical 950, particle size distribution by weight. This powder was made and then successfully cold sprayed using the BPCS process to show the range of materials and nanoparticle sizes that can be added. FIG. 9*c* shows, 960 a 400× image of the 5000 grit abraded surface of a cold spray deposition of a P-type bismuth telluride powder with the 900 particle size distribution that has been modified by the addition of 10 weight percent Carbodeon Amine P 5 nm synthetic diamond particles.

The invention claimed is:

1. A device comprising:

a body;

a coating of a powder disposed on the body, the coating being deposited in layers, the layers having a thickness within a range of 20 μm through 2 cm, the powder comprising particles of irregularly shaped elements, the particles being a mixture of at least two different brittle functional materials, wherein the at least two different brittle functional materials are from a same category of brittle functional materials or from different categories of brittle functional materials, diameters of the particles being in an inclusive range of 0.1 μm through 15 μm, and span 1.5 orders of magnitude or greater in size within the inclusive range, the diameters of the particles being distributed across the inclusive range according to a concentration of particles with diameters in a first particle size range from 0.1 μm through 1.0 μm, diameters in a second particle size range from 1.0 μm through 3.0 μm, diameters in a third particle size range from 3.0 μm through 6 μm, diameters in a fourth particle size range from 6.0 μm through 10.0 μm, and diameters in a fifth particle size range from 10.0 μm through 15 μm, wherein a number of particles in the first particle size range of the concentration is a majority of all particles in the concentration, the irregularly shaped elements are directly, mechanically interlocked together, without an additional binding agent, as a result of supersonic impact with the body or one another so as to form the layers at a substantially theoretical density, and the irregularly shaped elements retain a pre-deposition functional property of the at least two different brittle functional materials.

2. The device of claim 1, wherein irregularly shaped elements of a first of the at least two different brittle functional materials having a distribution among the first particle size range, the second particle size range, the third particle size range, the fourth particle size range, and the fifth particle size range and span the inclusive range of 0.1 μm through 15 μm, and irregularly shaped elements of a second of the at least two different brittle functional materials having a substantially same distribution as the distribution.

3. The device of claim 1, wherein irregularly shaped elements of a first of the at least two different brittle functional materials having a distribution among the first particle size range, the second particle size range, the third particle size range, the fourth particle size range, and the fifth particle size range and span the inclusive range of 0.1 μm through 15 μm, and irregularly shaped elements of a second of the at least two different brittle functional materials having a different distribution than the distribution among the first particle size range.

4. The device of claim 1, wherein the same category or the different categories of the brittle functional materials being selected from at least one of a thermoelectric material category, a piezoelectric semiconductor material category, a hard magnetic material category, a soft magnetic material category, or
an optical material category.

5. The device of claim 1, wherein the at least two different brittle functional materials comprising a functional ceramic material including at least one of
a silicon dioxide material,
an aluminum oxide material,
a zirconium oxide material,
a hafnium dioxide material,
a silicon carbide material,
a boron carbide material, or
a diamond material, wherein the functional ceramic material having a melt temperature above 2000° C.

6. The device of claim 1, wherein irregularly shaped elements of a first of the at least two different brittle functional materials having a first distribution that includes diameters of particles in only a subset of the first particle size range, the second particle size range, the third particle size range, the fourth particle size range, and the fifth particle size range, irregularly shaped elements of a second of the at least two different brittle functional materials having a second distribution that is different than the first distribution, and irregularly shaped elements of a combination of the first of the at least two different brittle functional materials and the second of the at least two different brittle functional materials having a combined distribution that includes elements in each of the first particle size range, the second particle size range, the third particle size range, the fourth particle size range, and the fifth particle size range and span the inclusive range of 0.1 μm through 15 μm.

7. The device of claim 1, wherein irregularly shaped elements of a first of the at least two different brittle functional materials having a first distribution that includes diameters of particles in only a subset of the first particle size range, the second particle size range, the third particle size range, the fourth particle size range, and the fifth particle size range, irregularly shaped elements of one or more other different brittle functional materials of the at least two different brittle functional materials having a combined second distribution that is different than the first distribution, and irregularly shaped elements of a combination of the first of the at least two different brittle functional materials and the one or more other different brittle functional materials having a combined distribution that includes elements in each of the first particle size range, the second particle size range, the third particle size range, the fourth particle size range, and the fifth particle size range and span the inclusive range of 0.1 μm through 15 μm.

8. The device of claim 7, wherein the same category or different categories of the brittle functional materials being selected from at least one of
a semiconductor material category,
an ionic semiconductor material category,
a superconductor material category,
a hard magnetic material category,
a soft magnetic material category, or
an optical material category.

9. The device of claim 7, wherein the different at least two different functional materials comprising a functional ceramic material including at least one of
a silicon dioxide material,
an aluminum oxide material,
a zirconium oxide material,
a hafnium dioxide material,
a silicon carbide material,
a boron carbide material, or
a diamond material, wherein the functional ceramic material having melt temperatures above 2000° C.

10. The device of claim 7, wherein at least one of the at least two brittle functional materials is mixed with at least one of a simulated extraterrestrial soil or an actual extraterrestrial soil.

11. A device comprising:

a body;

a coating of a powder disposed on the body, the coating being deposited in layers, the layers having a thickness within a range of 100 μm through 2 cm, the powder comprising a mixture of a set of irregularly shaped elements and a set of substantially cylindrically shaped fibers, the set of irregularly shaped elements being composed of one or more brittle functional materials from a same category of brittle functional materials or from one or more different categories of brittle functional materials, wherein diameters of the set of irregularly shaped elements are in an inclusive range of 0.1 μm through 15 μm, and span a minimum of 1.5 orders of magnitude in size within the inclusive range, the set of irregularly shaped elements having a 75% through 98% weight distribution in the powder, the set of substantially cylindrically shaped fibers having a 2% through 25% weight distribution in the powder, fibers in the set of substantially cylindrically shaped fibers comprising at least one of ceramic fibers or carbon fibers, and having diameters within an inclusive range from 500 nm through 3 μm, the fibers in the set of substantially cylindrically shaped fibers having lengths in an inclusive range from 10 μm through 200 μm, and the elements in the set of irregularly shaped elements and the fibers in the set of substantially cylindrically shaped fibers are directly, mechanically interlocked together, without an additional binding agent, as a result of supersonic impact with the body or one another so as to form dense random fiber reinforced composite material layers at a substantially theoretical density, wherein the elements in the set of irregularly shaped elements and the fibers in the set of substantially cylindrically shaped fibers retain a pre-deposition functional property.

12. The device of claim 11, wherein the fibers of the set of substantially cylindrically shaped fibers comprise a high temperature capability thermal protection material capable of withstanding temperatures greater than 1500° C. without melting.

13. The device of claim 11, wherein the ceramic fibers or carbon fibers in the set of substantially cylindrically shaped fibers includes at least one of
a silicon dioxide material,
a mullite material,
a zirconium dioxide material, or
carbon material.

14. The device of claim 11, wherein the elements in the set of irregularly shaped elements including at least one of a silicon dioxide material, an aluminum oxide material, a zirconium oxide material, a hafnium oxide material, a silicon carbide material, or a boron carbide material.

15. A nanoparticle enhanced composite material device comprising:

a body;

a coating disposed on the body, the coating including a dense material layer greater than 20 μm in thickness, a powder comprising particles, the particles being a mixture of a set of brittle functional material particles and a set of nanoparticle material chemical compound particles, the set of brittle functional material particles comprising one or more different brittle functional materials having irregularly shaped elements, the irregularly shaped elements spanning a minimum of 1.5 orders of magnitude in size within the inclusive range of 0.1 μm through 15 μm, particles in the set of brittle functional material particles having an 80.0% through 99.99% weight distribution in the powder, particles in the set of nanoparticle material chemical compound particles having a 0.01% through 20.0% weight distribution in the powder, and having particle diameters in an inclusive range of 5.0 nm through 100 nm, particles in the set of brittle functional material particles and particles in the set of nanoparticle material chemical compound particles are directly, mechanically interlocked together, without an additional binding agent, as a result of supersonic impact with the body or one another so as to form the dense material layer at a substantially theoretical density, wherein particles in the set of nanoparticle material chemical compound particles enhance a pre-deposition functional property of the particles in the set of brittle functional material particles.

16. The device of claim 15, wherein the particles in the set of brittle functional material particles being one or a combination of brittle functional material particles selected from a group consisting of a thermoelectric semiconductor material, a piezoelectric semiconductor material, a hard magnetic material, a soft magnetic material, a Lithium Nickel Manganese Cobalt Oxide compound, and a Lithium Iron Phosphate compound.

17. The device of claim 15, wherein the particles in the set of nanoparticle material chemical compound particles including at least one of a synthetic diamond, a silicon carbide, a fumed silica, an electrically conductive carbon black, or a carbon nanotube.

18. The device of claim 15, wherein the particles in the set of nanoparticle material chemical compound particles comprising metallic materials, and at least one of the metallic materials being at least one of aluminum, silver, or copper.

19. A device comprising:

a body;

a coating of powder disposed on the body, the coating being deposited in layers with thicknesses in a range of 20 μm through 2 cm, the powder comprising particles that are irregularly shaped elements, the particles including at least one of a metallic functional material or a polymeric functional material, the particles having diameters in an inclusive range of 0.1 μm through 15 μm, and spanning 1.5 orders of magnitude in size within the inclusive range of 0.1 μm through 15 μm, the diameters of the particles being distributed across the inclusive range according to a concentration of particles with diameters in a first particle size range from 0.1 μm through 1.0 μm, diameters in a second particle size range from 1.0 μm through 3.0 μm, diameters in a third particle size range from 3.0 μm through 6 μm, diameters in a fourth particle size range from 6.0 μm through 10.0 μm, and diameters in a fifth particle size range from 10.0 μm through 15 μm, wherein a number of particles in the first particle size range of the concentration is a majority of all particles in the concentration, and the particles that are irregularly shaped elements are directly, mechanically interlocked together, without an additional binding agent, as a result of supersonic impact with the body or one another so as to form dense material layers at a substantially theoretical density, wherein the particles that are irregularly shaped elements retain a pre-deposition functional property of the at least one of the metallic functional material or the polymeric functional material.

* * * * *